US010586626B2

(12) United States Patent
Sekiya et al.

(10) Patent No.: US 10,586,626 B2
(45) Date of Patent: Mar. 10, 2020

(54) COPPER ALLOY WIRE ROD

(71) Applicant: Furukawa Electric Co., Ltd., Tokyo (JP)

(72) Inventors: Shigeki Sekiya, Tokyo (JP); Kengo Mitose, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/235,935

(22) Filed: Dec. 28, 2018

(65) Prior Publication Data

US 2019/0139669 A1 May 9, 2019

Related U.S. Application Data

(63) Continuation of application No. PCT/JP2017/037927, filed on Oct. 20, 2017.

(30) Foreign Application Priority Data

Dec. 1, 2016 (JP) ..... 2016-234460

(51) Int. Cl.

| | |
|---|---|
| ***H01B 1/02*** | (2006.01) |
| ***H01B 13/00*** | (2006.01) |
| ***C22F 1/08*** | (2006.01) |
| ***C22C 9/00*** | (2006.01) |
| ***C22F 1/00*** | (2006.01) |

(52) U.S. Cl.

CPC ..... *H01B 1/026* (2013.01); *C22C 9/00* (2013.01); *C22F 1/002* (2013.01); *C22F 1/08* (2013.01); *H01B 13/002* (2013.01); *H01B 13/0016* (2013.01); *H01B 13/0036* (2013.01)

(58) Field of Classification Search

CPC ..... H01B 1/026; C22C 9/00; C22F 1/08

See application file for complete search history.

(56) References Cited

U.S. PATENT DOCUMENTS

2001/0041149 A1 11/2001 Mino
2014/0138120 A1* 5/2014 Watanabe ..... C22C 9/00 174/126.1

FOREIGN PATENT DOCUMENTS

| | | | |
|---|---|---|---|
| JP | H11293431 | A | 10/1999 |
| JP | 2001288517 | A | 10/2001 |
| JP | 2010229461 | A | 10/2010 |
| JP | 2011246802 | A | 12/2011 |
| JP | 5713230 | B2 | 3/2015 |
| JP | 2017002337 | A | 1/2017 |

(Continued)

OTHER PUBLICATIONS

English Translation of Decision to Grant dated Sep. 3, 2018, in the corresponding Japanese application No. 2018-512644.

(Continued)

*Primary Examiner* — Anthony J Zimmer
*Assistant Examiner* — Ricardo D Morales
(74) *Attorney, Agent, or Firm* — Dorsey & Whitney LLP

(57) ABSTRACT

A copper alloy wire rod having an alloy composition containing 0.5 to 6.0% by mass of Ag, 0 to 1.0% by mass of Mg, 0 to 1.0% by mass of Cr, and 0 to 1.0% by mass of Zr, with the balance being Cu and inevitable impurities, wherein an average closest particle distance of second phase particles having a particle size of 200 nm or less is 580 nm or less in a cross section perpendicular to a longitudinal direction of the wire rod.

5 Claims, 3 Drawing Sheets

(56) References Cited

FOREIGN PATENT DOCUMENTS

| | | | |
|---|---|---|---|
| JP | 6284691 | B1 | 5/2017 |
| WO | 2017199906 | A | 11/2017 |

OTHER PUBLICATIONS

English Translation of Notice of Reason for Rejection dated May 7, 2018, in the corresponding Japanese application No. 2018-512644.
International Search Report and Written Opinion dated Jan. 23, 2018 for PCT/JP2017/037927, 9 pages (English translation of ISR).
PCT, "International Preliminary Report on Patentability", Application No. PCT/JP2017/037927, dated Jun. 4, 2019, 11 pages.
PCT, "Written Opinion of the International Searching Authority", Application No. PCT/JP2017/037927, dated Jan. 23, 2018, 12 pages.
English translation of KR Office Action for Application No. 10-2018-7017607, dated Nov. 22, 2019.

* cited by examiner

COPPER ALLOY WIRE ROD

CROSS REFERENCE TO RELATED APPLICATIONS

This is a continuation application of international patent Application No. PCT/JP2017/037927 filed Oct. 20, 2017, which claims the benefit of Japanese Patent Application No. 2016-234460, filed Dec. 1, 2016, the full contents of both of which are hereby incorporated by reference in their entirety.

BACKGROUND

Technical Field

The present disclosure relates to a copper alloy wire rod suitably used for a wire rod for magnet wires, a micro coaxial cable and the like. The copper alloy wire rod requires high flexibility, high conductivity, and high vibration endurance.

Background

A wire rod for magnet wires used for a micro speaker and the like, and a micro coaxial cable simultaneously require moderate strength which can endure tension during the manufacturing process of the wire rod or when the wire rod is formed in a coil shape, high flexibility which can provide flexible bending and formation into a coil and the like, and high conductivity for conducting more electricity. In recent years, since a reduction in the diameter of the wire rod progresses due to the miniaturization of electronic equipment, these requirements have become more severe.

A copper alloy wire containing silver is conventionally utilized for the wire rod. This is because silver added into copper appears as a crystallized/precipitated deposit and has an effect of increasing strength, and possesses a property of providing only a small decrease in conductivity even if silver is added into copper, although conductivity generally decreases when an additive element forms a solid solution in copper. Hitherto, there have been known a Cu—Ag alloy wire in which the area rate of crystallized/precipitated deposits having a maximum length across a straight line of 100 nm or less is 100% (Japanese Patent No. 5713230), and a copper alloy wire in which the number of crystallized/precipitated deposits having a distance between crystallized/precipitated deposits closest to each other of d/1000 or more and d/100 or less, and a size of a crystallized/precipitated deposit phase of d/5000 or more and d/1000 or less, relative to a wire diameter d is 80% or more of a total number of the crystallized/precipitated deposits (described in Japanese Patent Application No. 2015-114320).

However, in these conventional techniques, the strength of the wire rod is improved by precipitation strengthening or dispersion strengthening and the like of the crystallized/precipitated deposits, while the rigidity of the wire rod also tends to increase, and the flexibility of the wire rod tends to decrease. For example, in Patent Document 1, all samples in test examples are subjected to wire drawing without being subjected to a last heat treatment, whereby flexibility is expected to run short. Generally, if the rigidity of the wire rod becomes too high, the wire rod cannot be wound in a line when the wire rod is rewound around a spool (bobbin), which causes a phenomenon in which the wire rod protrudes. If such a phenomenon occurs, the wire rod tangles when the wire rod is unreeled from the spool, which causes troubles such as disconnection and involution. In order to prevent such troubles from occurring, it is desirable that the wire rod is flexibly wound around the spool. From such a viewpoint, high flexibility is required for the wire rod.

Meanwhile, for example, in a micro speaker and the like, a coil obtained by winding a wire rod for magnet wires dozens of times is used, and the coil is vibrated by current to provide sound. In such a speaker, an end portion of the wire rod is connected to a terminal of the speaker, which allows electrical connection. The end portion is usually caulked or soldered for fixing, and the coil itself is also fixed by a fusion agent. However, since vibration is caused between the end portion of the wire rod and the coil by the vibration of the coil, the wire rod may be disconnected near the end portion when the vibration endurance of the wire rod is low. Therefore, high vibration endurance is also required for the wire rod for such an application. Furthermore, in recent years, great current tends to be required in order to secure a good sound source, which causes large amplitude of the coil. Hereafter, the tendency is considered to further accelerate.

SUMMARY

The present disclosure has been made in light of the actual situation described above, and an object of the present disclosure is to provide a copper alloy wire rod simultaneously having high flexibility, high conductivity, and high vibration endurance.

The present inventors have particularly carried out assiduous studies on the relationship between vibration endurance and crystallized/precipitated deposits. As a result, the inventors reached the findings that, by controlling the average closest particle distance of second phase particles having a predetermined particle size within a predetermined range, vibration endurance can be particularly improved in even a wire rod heat-treated to impart flexibility. On the basis of such findings, the present disclosure has been completed.

That is, the summary constitution of the present disclosure is as follows:

[1] A copper alloy wire rod having an alloy composition containing 0.5 to 6.0% by mass of Ag, 0 to 1.0% by mass of Mg, 0 to 1.0% by mass of Cr, and 0 to 1.0% by mass of Zr, with the balance being Cu and inevitable impurities, wherein an average closest particle distance of second phase particles having a particle size of 200 nm or less in a cross section perpendicular to a longitudinal direction of the wire rod is 580 nm or less.

[2] The copper alloy wire rod according to the above [1] wherein a total of a content of at least one component selected from the group consisting of Mg, Cr, and Zr in the alloy composition is 0.01% by mass or more.

[3] The copper alloy wire rod according to the above [1] or [2], wherein a dispersion density of second phase particles having a particle size larger than 500 nm is 0.16 particles/$\mu m^2$ or less in a range of 5 μm×5 μm in the cross section.

[4] The copper alloy wire rod according to any one of the above [1] to [3], wherein an average crystal grain size of a matrix is 0.1 to 1 μm in the cross section.

[5] The copper alloy wire rod according to any one of the above [1] to [4], wherein the number of times of vibration endurance is 5 million or more.

The present disclosure provides a copper alloy wire rod simultaneously having high flexibility, high conductivity, and high vibration endurance.

DETAILED DESCRIPTION

Figure 1A:
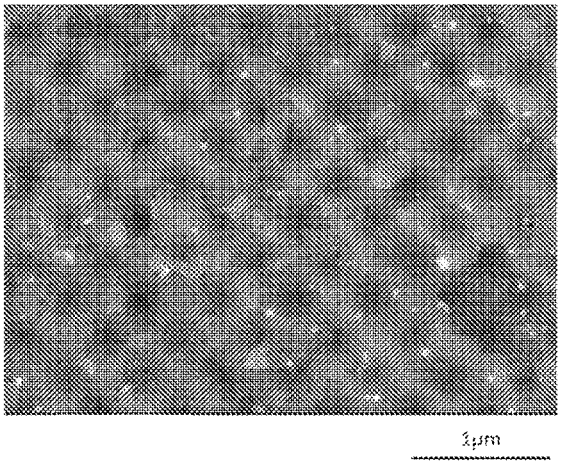
FIG. 1A is a SEM photograph when a cross section perpendicular to the longitudinal direction of a wire rod is subjected to buffing for specular finish to produce a sample for observation, and the cross section is observed by using a scanning electron microscope (SEM)

Hereinafter, preferred embodiments of a copper alloy wire rod of the present disclosure will be described in detail.

The copper alloy wire rod according to the present disclosure is characterized in that it has an alloy composition containing 0.5 to 6.0% by mass of Ag, 0 to 1.0% by mass of Mg, 0 to 1.0% by mass of Cr, and 0 to 1.0% by mass of Zr, with the balance being Cu and inevitable impurities, and an average closest particle distance of second phase particles having a particle size of 200 nm or less in a cross section perpendicular to a longitudinal direction of the wire rod is 580 nm or less.

Here, among the components for which a range of content is specified in the alloy composition, each of those components for which a lower limit value of the range of content is described as "0% by mass" means an optional additive component which is optionally added as required. That is, when the content of a predetermined additive component is "0% by mass", it means that the additive component is not contained.

(1) Alloy Composition

The alloy composition of the copper alloy wire rod of the present disclosure and its functions will be shown.

[Indispensable Additive Component]

The copper alloy wire rod of the present disclosure contains 0.5 to 6.0% by mass of Ag.

Ag (silver) is an element present in a state of forming a solid solution in matrix copper or in a state of being crystallized/precipitated as second phase particles during casting or precipitated as second phase particles in a heat treatment after casting (herein, these are generically called crystallized/precipitated deposits), and exhibiting an effect of strengthening solid solution or dispersion. The second phase means a crystal having a crystal structure different from that of a matrix (first phase) having a high copper content rate. In the case of the present disclosure, the second phase has a high silver content rate. When the content of Ag is less than 0.5% by mass, the effect is insufficient, which causes poor tensile strength and vibration endurance. When the content of Ag is larger than 6.0% by mass, conductivity decreases and the cost of raw materials also increases. Therefore, from the viewpoint of maintaining high strength and conductivity, the content of Ag is set to 0.5 to 6.0% by mass. Different strengths and conductivities are required for various applications, but a change in the content of Ag can produce a proper balance between the strength and the conductivity. In order to provide all the recently demanded characteristics, the content of Ag is preferably 1.5 to 4.5% by mass in respect of the balance between the strength and the conductivity. Herein, a crystal containing a large amount of silver appearing during solidification in casting and having a crystal structure different from that of a matrix is called a crystallized deposit. A crystal containing a large amount of silver appearing during cooling in casting and having a crystal structure different from that of the matrix is called a precipitated deposit. A crystal containing a large amount of silver precipitated or dispersed in a last heat treatment and having a crystal structure different from that of the matrix is called a second phase. The second phase particles mean particles containing the second phase.

[Optional Additive Components]

The copper alloy wire rod of the present disclosure further contains, in addition to Ag which is an indispensable additive component, at least one component selected from the group consisting of Mg, Cr, and Zr, as an optional additive element, each at preferably 1.5% by mass or less, more preferably 1.0% by mass or less, and still more preferably 0.5% by mass or less.

Mg (magnesium), Cr (chromium), and Zr (zirconium) are elements which are mainly present in a state of a solid solution in the matrix copper or in a state of the second phase together with Ag, and exhibit an effect of strengthening solid solution or dispersion as with the case of Ag. When the components are contained together with Ag, the components are present as a ternary or higher second phase such as a Cu—Ag—Zr-based phase, and contribute to dispersion strengthening. Therefore, in order to sufficiently exhibit the effect of strengthening dispersion, the total of the content of at least one component selected from the group consisting of Mg, Cr, and Zr is preferably set to 0.01% by mass or more. However, when each of the contents of Mg, Cr, and Zr is larger than 1.0% by mass, the conductivity tends to decrease, whereby the upper limit of each of the contents is more preferably 1.0% by mass. Therefore, from the viewpoint of maintaining high strength and conductivity, the total of the content of at least one component selected from the group consisting of Mg, Cr, and Zr is preferably set to 0.01 to 3.0% by mass. Furthermore, from the viewpoint of obtaining high conductivity, the total of the content is preferably set to 0.01 to 1.0% by mass.

[Balance: Cu and Inevitable Impurities]

The balance other than the components described above is Cu and inevitable impurities. Here, the inevitable impurities mean impurities contained in an amount which may be inevitably contained during a manufacturing step. Since the inevitable impurities may cause a decrease in conductivity depending on the content thereof, it is preferable to suppress the content of the inevitable impurities to some extent, considering the decrease in the conductivity. Examples of components which may be the inevitable impurities include Ni, Sn, and Zn.

(2) Method for Manufacturing Copper Alloy Wire Rod According to One Example of Present Disclosure The copper alloy wire rod according to one example of the present disclosure can be manufactured through a manufacturing method including sequentially performing steps of [1] melting, [2] casting, [3] wire drawing, and [4] a last heat treatment. After [4] the last heat treatment, a step of applying enamel, a step of applying a fusion agent, a step of providing a twisted wire, and a step of providing an electric wire by resin coating, and the like may be provided as required. Hereinafter, the steps of [1] to [4] will be described.

[1] Melting

In the melting step, a material is prepared by adjusting the amount of each component such that the aforementioned copper alloy composition is obtained, and the material is melted.

[2] Casting

The casting is performed through up cast type continuous casting. The coasting is a manufacturing method in which an ingot wire rod is drawn at a given interval to continuously obtain a wire rod. An ingot has a diameter of 10 mm. Preferably, an average cooling rate from 1085° C. to 780° C. during casting is set to 500° C./s or more. Since the size of the ingot influences crystal growth in a solidification process and the degree of deposition in a cooling process, it is possible to appropriately change the crystal growth and the degree of deposition so as to maintain the crystal growth and the degree of deposition in certain ranges, and the diameter is preferably 8 mm to 12 mm.

The average cooling rate from 1085° C. to 780° C. is set to 500° C./s or more in order to increase a temperature gradient during solidification to cause fine columnar crystals to appear and to make crystallized deposits be uniformly dispersed easily. When the average cooling rate from 1085° C. to 780° C. is less than 500° C./s, cooling unevenness occurs, which is apt to cause the crystallized deposits to be uneven, and the average closest particle distance of the second phase particles after the last heat treatment increases, whereby high vibration endurance may be unsatisfactory. When the average cooling rate from 1085° C. to 780° C. is larger than 1000° C./s, the filling up of a molten metal does not catch up too fast cooling, which causes the ingot wire rod to contain voids, thereby raising the possibility of disconnection during wire drawing.

The cooling rate during the casting is measured by setting a wire having an embedded R thermo couple and having a diameter of about 10 mm in a mold when the casting is started, and recording a change in a temperature when the wire is drawn. The R thermo couple is embedded so that the R thermo couple is located at the center of the wire. The drawing is started from a state where the tip of the R thermo couple is straightly immersed in a molten metal.

A heat treatment may be introduced before or during wire drawing in a conventional method for manufacturing a wire rod. However, the distribution state of the crystallized deposits crystallized in a cooling process during casting largely influences the average closest particle distance of the second phase particles after the last heat treatment, whereby the present disclosure does not perform a heat treatment before or during wire drawing in order to maintain the distribution state of the crystallized deposits obtained by controlling and adjusting the cooling rate during casting in a desired state.

[3] Wire Drawing

Then, an ingot wire rod obtained by casting or a wire rod subjected to a selection heat treatment is reduced in diameter by wire drawing. The wire drawing has an effect of elongating the crystallized/precipitated deposit in a wire drawing direction, which makes it possible to obtain a fibrous crystallized/precipitated deposit when being viewed in a cross section parallel to the longitudinal direction of the wire rod. In order to express such a fibrous crystallized/precipitated deposit with no bias in the wire rod, the design of a path schedule so that the wire are uniformly drawn internally and externally is required. In a dice of one path, a processing rate (cross section reduction rate) is preferably set to 10 to 30%. Since the shear stress of the dice is concentrically added to the surface of the wire rod when the processing rate is less than 10%, the surface of the wire rod is preferentially subjected to wire drawing, whereby a larger number of fibrous crystallized/precipitated deposits are distributed on the surface of the wire rod, and a comparatively smaller number of crystallized/precipitated deposits are distributed near the center of the wire rod. Therefore, bias occurs also in the average closest particle distance of the second phase particles after the last heat treatment, which makes it impossible to sufficiently provide vibration endurance. The processing rate is larger than 30%, which makes it necessary to increase a pulling-out force, thereby causing a high probability of disconnection. The last wire diameter of the copper alloy wire rod according to the present disclosure is preferably set to 0.15 mm or less, considering recent demand of diameter reduction. The rate of the surface area of the wire rod to the cross section increases in the wire diameter of less than 0.1 mm, whereby an influence on the average closest particle distance of the second phase particles after the last heat treatment in the present disclosure is small. Therefore, the processing rate of one path in the wire diameter of less than 0.1 mm is not limited to the processing rate of 10 to 30%. Rather, tension which can be endured during wire drawing is decreased by the reduction in the wire diameter, whereby the wire drawing may be carried out at the processing rate of less than 10%.

[4] Last Heat Treatment

Thereafter, the wire rod subjected to wire drawing is subjected to the last heat treatment. The heat treatment is performed in order to obtain the second phase particles dispersed at a predetermined average closest particle distance, which makes it possible to provide the wire rod having high flexibility. A retention time for the last heat treatment is preferably short, and the retention time is set to 10 seconds or less. When the heat treatment time is more than 10 seconds, the second phase particles tend to be too large. This is because breaking progresses with the large second phase particles as a starting point during vibration, which causes disconnection. Such short-time heat treating equipment is an energization heat treatment which sends electricity through the wire rod to perform a heat treatment using own Joule heat, or an inter-running heat treatment which subjects a wire to a heat treatment while continuously passing the wire through a heated furnace. A heat treatment temperature is also important in order to disperse the second phase particles at a predetermined average closest particle distance. The heat treatment temperature of the last heat treatment is set to 380 to 450° C. When the heat treatment temperature of the last heat treatment is less than 380° C., removal of processing strain as another object of the heat treatment cannot be attained in a time as short as 10 seconds, which cannot provide sufficient flexibility. When the heat treatment temperature of the last heat treatment is more than 450° C., the second phase particles tend to be too large after all, and breaking progresses with the large second phase particles as a starting point during vibration, which is apt to cause disconnection.

The cooling rate during the last heat treatment is desirably high from the viewpoint of preventing the particle size of the second phase particles from becoming too large, and the average cooling rate from the heat treatment temperature to 300° C. is more preferably 50° C./s or more.

In the present disclosure, the cooling rate is controlled in [2] the casting to homogenize the distribution of the crystallized deposits, and the fibrous crystallized/precipitated deposits are expressed in the wire rod with no bias in the cross section parallel to the longitudinal direction of the wire rod by the design of the path schedule in [3] the wire drawing. Then, [4] the last heat treatment is performed, which can provide a metal structure in which the second phase particles having a predetermined particle diameter size in the cross section perpendicular to the longitudinal direction of the wire rod are dispersed at a predetermined average closest particle distance. Thus, in order to provide the metal structure in which the second phase particles are dispersed at a predetermined average closest particle distance, the combination of the above steps is particularly important. The present disclosure has been completed based on these findings.

(3) Structure Feature of Copper Alloy Wire Rod of Present Disclosure

The copper alloy wire rod of the present disclosure manufactured by (1) the alloy composition and (2) the manufacturing method described above is characterized in that the average closest particle distance of the second phase particles having a particle size of 200 nm or less in the cross section perpendicular to the longitudinal direction of the wire rod is 580 nm or less. The longitudinal direction of the wire rod corresponds to the wire drawing direction when the wire rod is manufactured.

Generally, the copper alloy wire rod tends to have performance maintainable even under a high cycle, with respect to cyclic fatigue having a comparatively small load such as vibration. However, still, since the metal structure forming the wire rod is a polycrystalline form, even cyclic fatigue having a small load causes microscopic strain. Here, a state where the metal structure is distorted means that a crystal structure is confused by defects and irregular sequence of atoms and the like. At first, even if the strain is microscopic, the strain is accumulated in the metal structure by cyclic fatigue, and before long, the strain is larger, which causes a structure having large atomic arrangement disorder and voids. Furthermore, if further stress concentration occurs at such a defect place, the defect further expands, which causes the metal structure to be broken, resulting in the disconnection of the wire rod.

The present inventors have paid attention to the above phenomenon and carried out assiduous studies. As a result, the present inventors reached the findings that the second phase particles are present in the metal structure; as the distance is smaller, the strain is blocked by the second phase particles, which is less likely cause the strain to gather; and the above structure defect is less likely to expand, which provides performance maintainable even under a high cycle.

The present inventors have further carried out studies and reached the findings that a prominent effect is exhibited by dispersing the second phase particles having a given particle diameter at a narrower distance in the cross section perpendicular to the longitudinal direction in the metal structure. That is, in the present disclosure, the average closest particle distance of the second phase particles having a particle size of 200 nm or less is set to 580 nm or less in the cross section perpendicular to the longitudinal direction of the wire rod. The above range makes it possible to effectively suppress the expansion of the structure defect caused by comparatively small cyclic fatigue such as vibration, which can provide sufficiently improved vibration endurance.

In the wire rod of the present disclosure, the narrower closest particle distance of the second phase particles is considered to make it possible to effectively prevent the expansion of the structure defect, but the narrower closest particle distance of the second phase particles causes decreased elongation as an index of flexibility and tends to cause increased 0.2% proof stress. Therefore, from the balance with the flexibility, the average closest particle distance of the predetermined second phase particles is preferably 140 nm or more. When the flexibility is considered to be more important, the average closest particle distance of the second phase particles is preferably set to 250 nm or more. When the flexibility is considered to be still more important, the average closest particle distance of the second phase particles is preferably set to 440 nm or more. The upper limit of the average closest particle distance of the second phase particles is 580 nm as described above from the viewpoint of preventing the expansion of the structure defect.

For example, a copper alloy wire described in Patent Application No. 2015-114320 has a metal structure containing crystallized/precipitated deposits having a large size, whereby high vibration endurance cannot be expected, or the crystallized/precipitated deposits having a large size may conversely impair vibration endurance. When the second phase particles having a particle size larger than 500 nm are independently present, the second phase particles usually have a minor influence and can be disregarded. However, when the second phase particles having a particle size larger than 500 nm are compactly present, the accumulation of strain concentrates on the second phase particles during vibration, and breaking progresses with the second phase particles as a starting point, which tends to be apt to cause the disconnection of the wire rod. Therefore, in the present disclosure, the dispersion density of the second phase particles having a particle size larger than 500 nm is preferably 0.16 particles/$\mu m^2$ or less, and more preferably 0.10 particles/$\mu m^2$ or less in a range of 5 μm×5 μm in the cross section perpendicular to the longitudinal direction of the wire rod. Since the lower dispersion density of the second phase particles having a particle size larger than 500 nm can maintain higher vibration endurance, the dispersion density is most preferably 0 particle/$\mu m^2$.

Herein, the particle size, the closest particle distance, and the dispersion density are calculated by observing the cross section perpendicular to the longitudinal direction of the wire rod using a scanning electron microscope (SEM), and analyzing the image of the metal structure photographed on the observed cross section using an image processing device.

Specifically, the particle size is determined as follows: the image of the metal structure of the cross section photographed by SEM is analyzed by an image processing device; the area of a particle selected on the image (in the case of the second phase particles, an independent particle which does not aggregate with other particles) is determined; the diameter of a circle equivalent to the area (circle equivalent diameter) is calculated; and the circle equivalent diameter is taken as the size of the selected particle. The measuring method will be described in more detail in Examples.

Furthermore, the closest particle distance is determined as follows: the image of the metal structure of the cross section photographed by SEM is analyzed by an image processing device; a distance between the profile of a particle selected on the image and the profile of a particle adjacent thereto is determined; and the shortest distance between the profiles is taken as the closest particle distance. The average closest particle distance is determined as follows: 10 object particles (second phase particles having a particle size of 200 nm or less) are optionally selected in an observation area (2 μm×3 μm); the closest particle distances of these particles is determined; and these are averaged (N=10). The average closest particle distance is preferably confirmed and averaged in a plurality of cross sections, and averaged in at least three or more views. The measuring method will be described in more detail in Examples.

The dispersion density is determined as follows: the image of the metal structure of the cross section photographed by SEM is analyzed by an image processing device; the number of object particles (second phase particles having a particle size larger than 500 nm) in an observation range (5 μm×5 μm) is counted; the counted number is divided by the area (25 $\mu m^2$) of the observation range to determine the number of the object particles per unit area; and the number of the object particles per unit area is taken as the dispersion density. The measuring method will be described in more detail in Examples.

In the metal structure forming the wire rod, as the crystal grain size of the matrix is larger, the accumulation of the strain is apt to concentrate, and a strain increase rate accelerates, which tends to be apt to result in the breaking of the wire rod. Therefore, the crystal grain size of the matrix is preferably smaller, and the average crystal grain size of the matrix in the cross section perpendicular to the longitudinal direction of the wire rod is more preferably 1 μm or less. It is considered that, by the range, the accumulation place of the strain is dispersed, which is less likely to cause the wire rod to be broken. The crystal grain size of the matrix is desirably smaller, but the crystal grain size is restrained when performing the step of controlling the closest particle distance of the second phase particles having a predetermined particle size to a moderate distance, whereby the average crystal grain size of the matrix in the cross section is preferably set to 0.1 μm or more. That is, the average crystal grain size of the matrix in the cross section perpendicular to the longitudinal direction of the wire rod is preferably 0.1 to 1 μm. In respect of improving the number of times of vibration endurance, the average crystal grain size of the matrix is more preferably 0.12 to 0.74 μm, and in respect of obtaining the number of times of vibration endurance of 10 million or more, the average crystal grain size of the matrix is particularly preferably 0.12 to 0.41 μm.

Herein, the average crystal grain size of the matrix is calculated by observing the cross section perpendicular to the longitudinal direction of the wire rod by a scanning electron microscope (SEM) or an optical microscope, and using the image of the metal structure photographed on the observed cross section. Specifically, the crystal grain size is calculated by a crossing method based on the image of the metal structure of the cross section photographed by SEM and the like. The number of grain boundaries crossed by the crossing method is set to 50 or more, and the average value thereof is taken as the average crystal grain size. When the number of grain boundaries is less than 50 in one observation view, a plurality of photographs may be taken. The measuring method will be described in more detail in Examples.

(4) Characteristics of Copper Alloy Wire Rod of Present Disclosure

The copper alloy wire rod of the present disclosure has excellent vibration endurance. The vibration endurance is measured with the number of repetitions until the wire rod is broken by using a high cyclic fatigue test machine as the number of times of vibration endurance. In the copper alloy wire rod of the present disclosure, the number of times of vibration endurance is preferably 5 million or more. The measuring method will be specifically described in Examples to be described later.

It is desirable that, when a coil for micro speakers is formed, a wire rod is flexibly bent during forming working, or the wire rod is likely to be treated during an energization heat treatment, an inter-running heat treatment, or enamel application. Therefore, high flexibility is required for the copper alloy wire rod. The copper alloy wire rod preferably has a higher elongation and a smaller 0.2% proof stress as the indexes. That is, the copper alloy wire rod of the present disclosure has an elongation (%), based on JIS Z2241, of preferably 5% or more, more preferably 10% or more, and still more preferably 15% or more. The copper alloy wire rod has a 0.2% proof stress, based on JIS Z2241, of preferably 700 MPa or less, and more preferably 650 MPa or less.

The copper alloy wire rod is required to have high conductivity in order to prevent generation of heat caused by Joule heat. Therefore, the copper alloy wire rod of the present disclosure preferably has conductivity of 80% IACS or more.

Hereinbefore, embodiments of the present disclosure have been described. However, the present disclosure is not limited to the embodiments, and includes all aspects included in the concept of the present disclosure and appended claims, and various modifications can be made within the scope of the present disclosure.

EXAMPLES

Thereafter, in order to further clarify the effects of the present disclosure, Examples and Comparative Examples will be described, but the present disclosure is not limited to these Examples.

Examples 1 to 26 and Comparative Examples 1 to 6

Raw materials (oxygen-free copper, silver, magnesium, chromium, and zirconium) were introduced into a graphite crucible so as to provide alloy compositions of Table 1, and a furnace temperature in the crucible was heated to 1250° C. or more, to melt the raw materials. A resistance heating type was used for melting. An atmosphere in the crucible was a nitrogen atmosphere so that oxygen was not mixed in melted copper. Furthermore, after the crucible was held at 1250° C. or more for 3 hours or more, an ingot having a diameter of about 10 mm was cast in a graphite mold while a cooling rate was variously changed as shown in Table 1. The cooling rate was changed by adjusting a water temperature of a water cooler and an amount of water. After the casting was started, continuous casting was performed while the raw materials were appropriately introduced. When chromium was contained in the raw materials (Examples 9, 11, 12, and 14), the raw materials were melted while the temperature in the crucible was held at 1600° C. or more.

Thereafter, the ingot was subjected to wire drawing at a processing rate of 12 to 26% so that a wire diameter was set to 0.1 mm. Then, processing materials subjected to wire drawing were subjected to last heat treatments having conditions shown in Table 1 under a nitrogen atmosphere, to obtain copper alloy wire rods (Examples 1 to 26 and Comparative Examples 1 to 6). The heat treatment was performed by an inter-running heat treatment.

Comparative Example 7

In Comparative Example 7, a copper alloy wire rod was obtained by the same method as that of Example 1 except that raw materials were prepared so as to provide an alloy composition shown in Table 1; a cooling rate after casting was set to a condition shown in Table 1; and a last heat treatment was not performed.

Comparative Example 8

In Comparative Example 8, a copper alloy wire rod was obtained by the same method as that of Example 1 except that raw materials were prepared so as to provide an alloy composition shown in Table 1; a cooling rate after casting was set to a condition shown in Table 1; an ingot after casting was subjected to wire drawing at a processing rate of 6 to 22% so that a wire diameter was set to 0.1 mm; and a last heat treatment was performed under a condition shown in Table 1.

(Evaluation)

The copper alloy wire rods according to Examples and Comparative Examples were subjected to measurements and evaluations to be described later. Evaluation conditions are as follows. The results are shown in Table 1.

[Structure Observation]

Figure 1B:
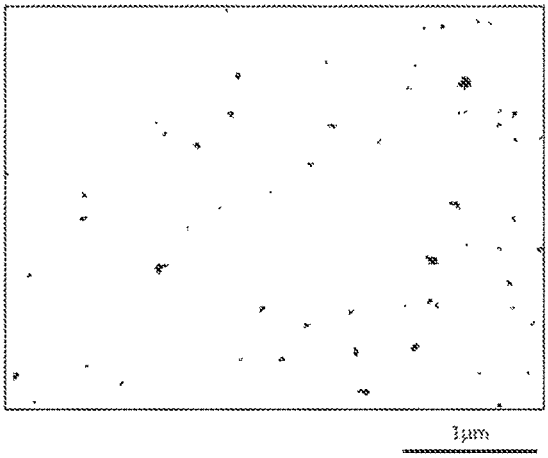
FIG. 1B shows the SEM photograph subjected to image processing.

(1) Average Closest Particle Distance of Second Phase Particles Having Particle Size of 200 nm or Less Hereinafter, a method for measuring an average closest particle distance will be described with reference to FIG. 1. FIG. 1 shows an example when a wire rod of Example 22 was subjected to structure observation. Other Examples and Comparative Examples were also subjected to the same measurement.

First, a wire rod was cut out along a cross section perpendicular to the longitudinal direction of the wire rod, and the cross section was subjected to specular finish by wet polishing and buffing. Then, the cross section after the finish was subjected to structure observation (photographing) in an observation view of 3 μm×4 μm at a magnification ratio of 20000 by using a scanning electron microscope (FE-SEM, manufactured by JEOL Co., Ltd. (JEOL)) (see FIG. 1A). The lower and upper limit threshold values of the photographed image were respectively set to 150 and 255 by using image size measurement software (Pixs2000_Pro, manufactured by Innotech Corporation). A point of segregation was removed by binary setting, while the inside was filled, thereby preparing an image after image processing (see FIG. 1B).

Figure 1C:
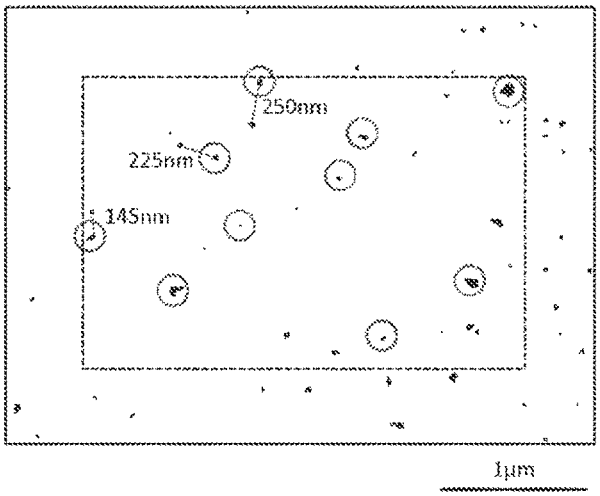
FIG. 1C shows an example obtained by selecting ten optional second phase particles, and calculating a closest particle distance of three second phase particles thereof.

Furthermore, the obtained image was analyzed, and a black portion area which was in a range of a circle equivalent diameter of 200 nm or less was taken as second phase particles having a particle size of 200 nm or less as an object to be observed. Furthermore, ten black portion areas in a range of 200 nm or less were optionally picked up in a range of 2 μm×3 μm excluding the end portions of 0.5 μm of the image. The closest particle distances of ten second phase particles having a particle size of 200 nm or less were determined, and averaged (see FIG. 1C). In FIG. 1C, the closest particle distances of three second phase particles of ten optionally selected second phase particles were calculated, and illustrated. Three views were subjected to the measurement, and the average value thereof was calculated.

If, rigorously, the contrast of a photograph to be taken is always fixed in the evaluation, and a second phase is not subjected to image processing, universal measurement cannot be performed. However, many change factors such as a sample state and a measurement environment exist, which actually makes it impossible to always fix the contrast of the photograph. Then, if the value measured for the wire rod of Example 22 is in a range of ±20% from the value of the present Example (value shown in Table 1) when the average closest particle distance is measured by the above observation technique, for example, suitable observation is determined to be performed. Suitable observation is also determined to be performed for other samples photographed and analyzed around the same time (the same also in measurement of the dispersion density of the second phase particles having a particle size larger than 500 nm to be described later, and the average particle diameter of matrix particles).

(2) Dispersion Density of Second Phase Particles Having Particle Size Larger than 500 nm A wire rod was cut out along a cross section perpendicular to the longitudinal direction of the wire rod, and the cross section was subjected to specular finish by wet polishing and buffing. Then, the cross section after the finish was subjected to structure observation (photographing) at a magnification ratio of 5000 by using a scanning electron microscope (same as above). The lower and upper limit threshold values of the photographed image were respectively set to 150 and 255 by using image size measurement software (same as above). A point of segregation was removed by binary setting, while the inside was filled, thereby preparing an image after image processing.

Furthermore, the obtained image was analyzed, and a black portion area which was in a range of a circle equivalent diameter larger than 500 nm was taken as second phase particles having a particle size larger than 500 nm as an object to be counted. An observation area was set to 5 μm×5 m, and the number of black portion areas which were in a range larger than 500 nm was counted. Dispersion density (particles/$\mu m^2$) was calculated by dividing the number of the second phase particles having a particle size larger than 500 nm by an observation range of 25 $\mu m^2$.

(3) Average Crystal Grain Size of Matrix

For the crystal grain size of the matrix, the cross section after the finish was subjected to structure observation (photographing) in an observation view of 3 μm×4 μm at a magnification ratio of 20000 by using the scanning electron microscope (same as above) as with the measurement of the average closest particle distance of the second phase particles having a particle size of 200 nm or less. The average crystal grain size was calculated by a crossing method based on the image. The number of grain boundaries crossed by the crossing method was set to 50 or more, and the average value thereof was taken as the average crystal grain size. When one observation view was insufficient, a plurality of photographs may be taken for measurement.

[Vibration Endurance]

Figure 2:
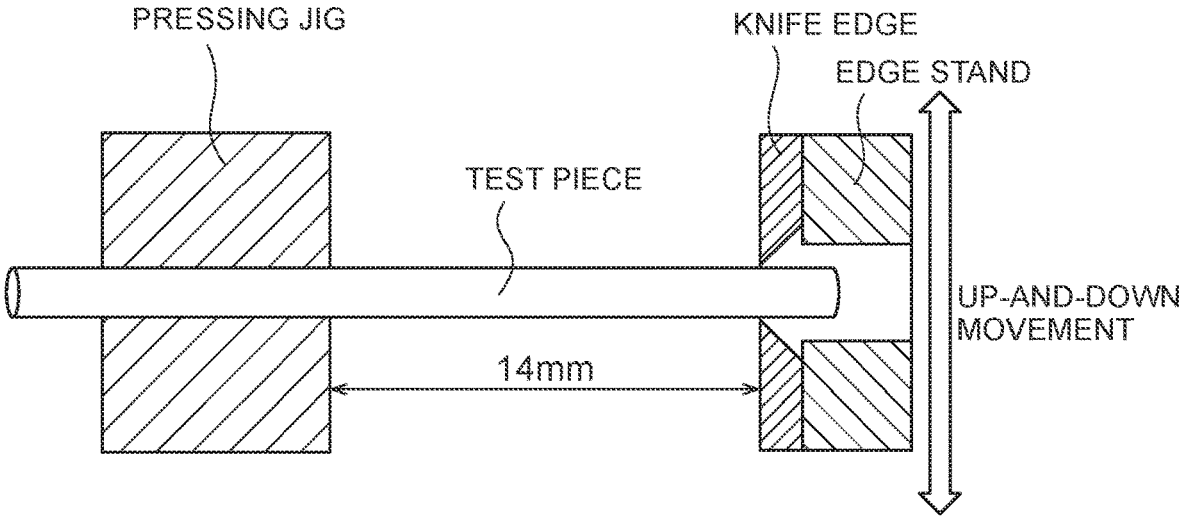
FIG. 2 is an illustration diagram of a test method when the vibration endurance of the wire rod is evaluated.

Vibration endurance was evaluated by using a fatigue test machine (AST52B, manufactured by Akashi Corporation (existing company Mitsutoyo Co., Ltd.). A specific diagram during evaluation of vibration endurance is shown in FIG. 2. As shown in FIG. 2, each of one end and another end of a test piece is fixed so that the one end is clipped by a pressing jig and the other end is clipped by a knife edge. The knife edge was vertically vibrated by ±2 mm with respect to the test piece thus disposed, for repeated bending, and the number of repetitions (number of times of vibration endurance) until the wire rod was broken was counted. Since the wire rod was crushed when the wire rod was dipped by the pressing jig for fixing at this time, the wire rod, and copper plates having a thickness of 0.1 mm were simultaneously clipped by the pressing jig in a state where the copper plates were placed on both the sides of the wire rod so as to be adjacent to the wire rod. Similarly, the wire rod and copper plates having a thickness of 0.1 mm were simultaneously clipped by the knife edge in a state where the copper plates were placed on both the sides of the wire rod so as to be adjacent to the wire rod. The wire diameter of the test piece was set to 0.1 mm, and the set length of the test piece was set to 14 mm.

Six wire rods according to each of Examples and Comparative Examples were subjected to the test, and the average value of the numbers of repetitions until the wire rods were broken was determined. In the present Examples, the wire rods in which the number of repetitions until the wire rods were broken was 5 million or more were taken as an acceptable level, and the wire rods in which the number of repetitions was 6 million or more were evaluated as better. Tests for the wire rods in which the number of repetitions was larger than 10 million were terminated, and written as ">1000" in Table 1.

[Elongation]

Elongation (%) was calculated by using a precision universal tester (manufactured by Shimadzu Corporation) according to JIS Z2241. Three wire rods according to each of Examples and Comparative Examples were subjected to the test, and the average value thereof (N=3) was determined and taken as elongation of each of the wire rods. The elongation was preferably larger, and the wire rods having elongation of 5% or more was taken as an acceptable level in the present Examples.

[Conductivity]

Figure 3:
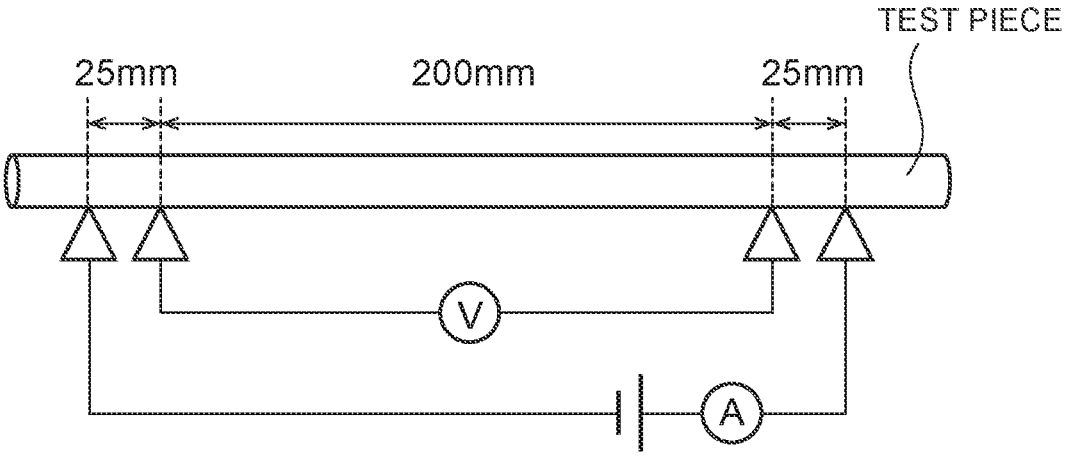
FIG. 3 is an illustration diagram of a test method when the conductivity of the wire rod is evaluated.

In a constant temperature bath held at 20° C. (±0.5° C.), resistivities were measured for three test pieces having a length of 300 mm using a four terminal method, and the average conductivity thereof was calculated. The distance between terminals was set to 200 mm. A specific diagram when conductivity is measured is shown in FIG. 3. The conductivity was preferably higher, and the test pieces having conductivity of 80% IACS or more were taken as an acceptable level in the present Examples.

[0.2% Proof Stress]

A tensile test was performed by using a precision universal tester (manufactured by Shimadzu Corporation) according to JIS Z2241, and 0.2% proof stress (MPa) was determined by an offset method. Three wire rods according to each of Examples and Comparative Examples were subjected to the test, and the average value thereof (N=3) was calculated, and taken as the 0.2% proof stress of each of the wire rods. The 0.2% proof stress was preferably smaller from the viewpoint of flexibility, and the wire rods having 0.2% proof stress of 700 MPa or less were taken as an acceptable level in the present Examples.

[Table 1]

| | | Alloy composition | | | | | | Manufacturing condition | | | | | Evaluation of structure | | | Evaluation of characteristics | | | |
|---|---|---|---|---|---|---|---|---|---|---|---|---|---|---|---|---|---|---|---|
| | | | | | | | | | Last heat treatment | | | | | | | | | | |
| | | indispensable additive | Optional additive component | | | | | Casting | | | Average cooling rate | Average closest particle | Dispersion density | | Number of | | | |
| | | | | | | | | Average cooling | Heat | | from heat treatment | distance of second phase | of second phase particles | Average crystal | times of vibration | | | |
| No. | | component Ag % by mass | Mg % by mass | Cr % by mass | Zr % by mass | Total content % by mass | Cu and inevitable impurities | rate from 1085° C. to 780° C. ° C./s | treatment temper-ature ° C. | Retention time s | temper-ature to 300° C. ° C./s | particles having particle size of 200 mm or less nm | having particle size larger than 500 mn Particles/μm$^2$ | grain size of matrix μm | endurance Ten thousand times | Elonga-tion % | Conduct-ivity % IACS | 0.2% proof stress MPa |
| Examples | 1 | 0.5 | — | — | — | — | Balance | 700 | 450 | 10 | 200 | 580 | 0.00 | 1.13 | 510 | 13 | 95 | 388 |
| | 2 | 1.0 | — | — | — | — | Balance | 700 | 450 | 10 | 200 | 500 | 0.00 | 0.74 | 670 | 11 | 94 | 418 |
| | 3 | 2.0 | — | — | — | — | Balance | 700 | 450 | 10 | 200 | 440 | 0.00 | 0.65 | 810 | 10 | 93 | 463 |
| | 4 | 3.0 | — | — | — | — | Balance | 700 | 450 | 10 | 200 | 370 | 0.00 | 0.41 | >1000 | 10 | 90 | 512 |
| | 5 | 4.0 | — | — | — | — | Balance | 700 | 450 | 10 | 200 | 330 | 0.00 | 0.26 | >1000 | 9 | 88 | 560 |
| | 6 | 5.0 | — | — | — | — | Balance | 700 | 450 | 10 | 200 | 240 | 0.05 | 0.19 | >1000 | 7 | 85 | 597 |
| | 7 | 6.0 | — | — | — | — | Balance | 700 | 450 | 10 | 200 | 140 | 0.10 | 0.14 | 780 | 5 | 82 | 634 |
| | 8 | 4.0 | 0.5 | — | — | 0.5 | Balance | 700 | 450 | 10 | 200 | 250 | 0.00 | 0.22 | >1000 | 9 | 87 | 589 |
| | 9 | 4.0 | — | 0.5 | | 0.5 | Balance | 700 | 450 | 10 | 200 | 240 | 0.00 | 0.19 | >1000 | 9 | 84 | 601 |
| | 10 | 4.0 | — | — | 0.5 | 0.5 | Balance | 700 | 450 | 10 | 200 | 240 | 0.00 | 0.19 | >1000 | 8 | 84 | 603 |
| | 11 | 4.0 | 0.5 | 0.5 | — | 1.0 | Balance | 700 | 450 | 10 | 200 | 230 | 0.00 | 0.19 | >1000 | 7 | 83 | 598 |
| | 12 | 4.0 | — | 0.5 | 0.5 | 1.0 | Balance | 700 | 450 | 10 | 200 | 210 | 0.00 | 0.17 | >1000 | 9 | 81 | 622 |
| | 13 | 4.0 | 0.5 | — | 0.5 | 1.0 | Balance | 700 | 450 | 10 | 200 | 210 | 0.00 | 0.19 | >1000 | 7 | 82 | 635 |
| | 14 | 4.0 | 0.5 | 0.5 | 0.5 | 1.5 | Balance | 700 | 450 | 10 | 200 | 190 | 0.00 | 0.14 | >1000 | 6 | 80 | 700 |
| | 15 | 4.0 | — | — | — | — | Balance | 700 | 400 | 5 | 50 | 210 | 0.00 | 0.20 | 850 | 7 | 86 | 588 |
| | 16 | 4.0 | — | — | — | — | Balance | 700 | 400 | 5 | 100 | 190 | 0.00 | 0.17 | >1000 | 7 | 85 | 606 |
| | 17 | 4.0 | — | — | — | — | Balance | 700 | 450 | 2 | 200 | 150 | 0.00 | 0.12 | >1000 | 5 | 84 | 633 |
| | 18 | 4.0 | — | — | — | — | Balance | 700 | 450 | 4 | 200 | 210 | 0.00 | 0.17 | >1000 | 6 | 86 | 608 |
| | 19 | 4.0 | — | — | — | — | Balance | 700 | 450 | 5 | 200 | 280 | 0.00 | 0.19 | >1000 | 8 | 87 | 590 |
| | 20 | 4.0 | — | — | — | — | Balance | 700 | 380 | 10 | 200 | 170 | 0.00 | 0.12 | >1000 | 6 | 83 | 633 |
| | 21 | 4.0 | — | — | — | — | Balance | 700 | 400 | 5 | 200 | 180 | 0.00 | 0.14 | >1000 | 6 | 85 | 626 |
| | 22 | 4.0 | — | — | — | — | Balance | 700 | 400 | 10 | 200 | 250 | 0.00 | 0.22 | >1000 | 6 | 87 | 590 |
| | 23 | 4.0 | — | — | — | — | Balance | 500 | 450 | 10 | 200 | 380 | 0.00 | 0.24 | >1000 | 8 | 88 | 552 |
| | 24 | 4.0 | — | — | — | — | Balance | 1000 | 450 | 10 | 200 | 250 | 0.16 | 0.24 | 660 | 7 | 88 | 585 |
| | 25 | 5.0 | — | — | — | — | Balance | 1000 | 450 | 10 | 200 | 210 | 0.20 | 0.18 | 550 | 6 | 87 | 657 |
| | 26 | 6.0 | — | — | — | — | Balance | 1000 | 450 | 10 | 200 | 140 | 0.23 | 0.13 | 520 | 5 | 85 | 602 |

-continued

| | | Alloy composition | | | | | | Manufacturing condition | | | | | | | | Evaluation of characteristics | | |
|---|---|---|---|---|---|---|---|---|---|---|---|---|---|---|---|---|---|---|
| | | | | | | | | | Last heat treatment | | | Evaluation of structure | | | | | | |
| | | indispensable additive component | Optional additive component | | | | | Casting | | | Average cooling rate | Average closest particle | Dispersion density | | Number of | | | |
| No. | | Ag % by mass | Mg % by mass | Cr % by mass | Zr % by mass | Total content % by mass | Cu and inevitable impurities | Average cooling rate from 1085° C. to 780° C. ° C./s | Heat treatment temperature ° C. | Retention time s | from heat treatment temperature to 300° C. ° C./s | distance of second phase particles having particle size of 200 mm or less nm | of second phase particles having particle size larger than 500 mn Particles/μm$^2$ | Average crystal grain size of matrix μm | times of vibration endurance Ten thousand times | Elongation % | Conductivity % IACS | 0.2% proof stress MPa |
| Comparative Examples | 1 | **8.0** | — | — | — | — | Balance | 600 | 450 | 10 | 200 | 80 | 0.18 | 0.40 | 600 | **3** | **74** | **730** |
| | 2 | 4.0 | — | — | — | — | Balance | 12 | 450 | 10 | 200 | **1010** | 0.00 | 1.10 | **210** | 10 | 88 | 554 |
| | 3 | 4.0 | — | — | — | — | Balance | 600 | 500 | 10 | 200 | **670** | 0.00 | 2.50 | **430** | 19 | 85 | 480 |
| | 4 | 4.0 | 0.5 | — | — | 0.5 | Balance | 600 | 450 | 1800 | 6 | **720** | 0.05 | 2.40 | **380** | 18 | 86 | 423 |
| | 5 | 4.0 | — | — | — | — | Balance | 600 | 450 | 5 | 1 | **660** | 0.02 | 0.25 | **430** | 9 | 88 | 582 |
| | 6 | 4.0 | 0.5 | — | — | 0.05 | Balance | 600 | 600 | 1800 | 5 | **1030** | 0.27 | 6.00 | **60** | 20 | 85 | 321 |
| | 7 | 5.0 | — | — | — | — | Balance | 12 | — | — | — | — | 0.00 | 0.90 | >1000 | **1** | **66** | 533 |
| | 8 | 4.0 | — | — | — | — | Balance | 800 | 400 | 5 | 200 | **720** | 0.20 | 0.90 | **420** | 6 | 85 | 472 |

(Note)

Underlined numerical values listed in boldface in Table mean that the nunlerica; values are outside the appropriate range of the present invention, and the evaluation results donut rise to an acceptable level in the present Examples.

From the results of Table 1, it was confirmed that each of the copper alloy wire rods according to Examples 1 to 26 of the present disclosure has a predetermined composition, and the average closest particle distance of the second phase particles having a particle size of 200 nm or less is controlled to 580 nm or less in the cross section perpendicular to the longitudinal direction of the wire rod, which provides high flexibility (elongation and 0.2% proof stress), high conductivity, and high vibration endurance.

Meanwhile, it was confirmed that each of the copper alloy wire rods of Comparative Examples 1 to 8 does not have a predetermined composition, or the average closest particle distance of the second phase particles having a particle size of 200 nm or less in the cross section perpendicular to the longitudinal direction of the wire rod is not controlled to 580 nm or less, whereby any one or more of flexibility (elongation and 0.2% proof stress), conductivity and vibration endurance of the copper alloy wire rod of each of Comparative Examples 1 to 8 are poorer than those of the copper alloy wire rod of each of Examples 1 to 26 according to the present disclosure.

The invention claimed is:

1. A copper alloy wire rod having an alloy composition containing 0.5 to 6.0% by mass of Ag, 0 to 1.0% by mass of Mg, 0 to 1.0% by mass of Cr, and 0 to 1.0% by mass of Zr, with the balance being Cu and inevitable impurities, wherein an average closest particle distance of second phase particles having a particle size of 200 nm or less is 580 nm or less in a cross section perpendicular to a longitudinal direction of the wire rod.

2. The copper alloy wire rod according to claim 1, wherein a total of a content of at least one component selected from the group consisting of Mg, Cr, and Zr is 0.01% by mass or more in the alloy composition.

3. The copper alloy wire rod according to claim 1, wherein a dispersion density of second phase particles having a particle size larger than 500 nm is 0.16 particles/$\mu m^2$ or less in a range of 5 μm×5 μm in the cross section.

4. The copper alloy wire rod according to claim 1, wherein an average crystal grain size of a matrix is 0.1 to 1 μm in the cross section.

5. The copper alloy wire rod according to claim 1, wherein the number of times of vibration endurance is 5 million or more.

* * * * *